United States Patent [19]

Bradley

[11] Patent Number: 4,940,238

[45] Date of Patent: Jul. 10, 1990

[54] GOLF PUTTING PRACTICE BALL AND SYSTEM

[76] Inventor: Robert J. Bradley, 216 Mardale Dr., Somerdale, N.J. 08083

[21] Appl. No.: 147,456

[22] Filed: Jan. 25, 1988

[51] Int. Cl.[5] ..... A63B 69/36; A63B 37/14

[52] U.S. Cl. ..... 273/199 R; 273/232; 273/218; 273/DIG. 20

[58] Field of Search ..... 273/183 C, 62, DIG. 20, 273/232, 199 R, 199 A, 218

[56] References Cited

U.S. PATENT DOCUMENTS

| | | | |
|---|---|---|---|
| 4,090,716 | 5/1978 | Martin et al. | 273/232 |
| 4,201,384 | 5/1980 | Barber | 273/183 C |
| 4,346,898 | 8/1982 | Badke | 273/232 |

*Primary Examiner*—George J. Marlo

*Attorney, Agent, or Firm*—Charles F. Duffield

[57] ABSTRACT

A golf putting practice system is disclosed which includes a spherical ball having the approximate weight and surface resiliency characteristics of a regulation golf ball but of increased diameter (in the range of 2 to 3 inches) but less than the diameter of a regulation golf putting hole and further wherein the surface thereof includes a pattern of dimples of configuration corresponding to that of a regulation golf ball but proportionately larger in accordance with the difference between the incrased diameter of the practice ball and the diameter of a regulation golf ball. The system further includes putting instructions prescribing certain putting drills based upon certain putting principles which drills utilize one or more practice balls to achieve proficiency of certain putting absolutes.

4 Claims, 2 Drawing Sheets

DRILL NO. 1

DRILL NO. 2

DRILL NO. 3

DRILL NO. 4

GOLF PUTTING PRACTICE BALL AND SYSTEM

BACKGROUND OF INVENTION

The present invention relates to the art area of golf and, more particularly, to a putting practice system designed to achieve putting proficiency utilizing a specially designed practice ball and instructions for the use of the practice ball.

In the game of golf, putting is the one area that a majority of qolfers can be helped and show great improvement quickly. A one foot putt and a 250 yard drive are both equal to a single stroke on a scorecard. Playing well from tee to green requires constant practice and good physical conditioning. Putting well is physically possible by all levels of golfers. Approximately 43% of the golf game is played on the putting surface. If putting can be mastered, almost half of the game thereby mastered.

There are certain putting absolutes that are recognized in the game of golf. The inventor, as a golf professional, believes that at least the following three putting absolutes must occur in order for anyone to successfully make a putt. These three absolutes are:

(1) The putter blade must be square or straight in relationship to the hole or immediate target when putting with a break in the green.

(2) The putter must be swung by the arms and hands directly toward the target.

(3) The person putting must develop the feel to consistently putt the ball a desired distance.

It is essential that the golfer clearly understand the importance of these putting absolutes and that the golfer concentrate his or her practice efforts to incorporating these absolutes into their putting stroke. There is no room for individual preferences or style in the absolutes and they are constant and must occur. Achievement of the putting absolutes occurs by following certain sound putting principles. It is the inventor's experience as a golf professional that there are at least ten such sound putting principles which must be followed or incorporated into the putting stroke. These ten are as follows:

(1) Put a mark on the sweet spot of your putter.

(2) Position yourself directly behind the ball and actually see the route the ball needs to travel to go in the hole. Mentally picture the ball rolling into the hole.

(3) Read the green for possible breaks —Look at the hole and see if it's tilted one way or the other. If it's tilted to the left, the ball will break from right to left at the cup. If the hole tilts right, the ball will roll from left to right. Generally, the ball will roll away from hills or mountains and toward water.

(4) Align your club face square or straight to the target.

(5) Position yourself so that your eyes are directly over the ball.

(6) Form a triangle with your shoulders and arms.

(7) Use your mind, which is a billion-dollar computer, to calculate the distance needed to roll the putt into the hole. Relax and allow your natural mental instincts to make the computation.

(8) Maintain a light grip pressure but keep your wrists firm.

(9) Take a short back swing and a full followthrough using a smooth pendulum-like motion.

(10) Totally concentrate on the target and not your stroke while actually putting.

The ten sound putting principles are designed to help the golfer incorporate the three putting absolutes into the putting stroke. The ten sound putting principles, unlike the absolutes, allow golfers room for individual preferences and styles. Those putting principles recognized by the inventor as set forth above are arranged in the best possible working order to aid the golfer in building a solid putting stroke.

The inventor, as a golf professional, has observed in his studies on putting that golfers are hit orientated. They tense up and pull the putter off line in their attempt to strike the golf ball, rather than stroking it. All levels of golfers do this to some extent.

Over the years, many different types and designs of teaching aids to assist golfers in their putting proficiency have been proposed, utilized and tried. These devices essentially are mechanical devices which will, to some degree, align or confine the golfer's stroke in direction, force and the like to hopefully improve the golfer's putting techniques. However, all of these devices are, to a more or less degree, bulky and otherwise unwieldy and incapable of being transported by the golfer readily between golf courses and upon the golf course itself. It has been the inventor's observations as a golf professional through his study and teaching that what is needed in the area of teaching of putting is a golf putting practice system which can be easily carried by the golfer to, from and upon the golf course and which will provide not only practice putting aids or devices but also instructional material as to the putting absolutes, principles and drills for utilization with the putting aids or devices to obtain putting proficiency. To achieve this end, the inventor has set forth to develop the practice putting ball and putting system based upon sound golf principles and scientific approach to produce results quickly for all levels of golfers as hereinafter described.

SUMMARY OF INVENTION

The golf putting practice system of the present invention is based upon a special putting practice ball and a practice manual. The special putting practice ball is a spherical ball having the approximate weight and surface resiliency characteristics of a regulation golf ball and of increased diameter substantially in excess of the diameter of a regulation golf ball but less than the diameter of a regulation golf putting hole. The surface of the practice putting ball includes a pattern of dimples of configuration corresponding to that of a regulation golf ball but proportionately larger in accordance with the increase in diameter of the practice putting ball over the diameter of a regulation golf ball.

The practice manual, which is of small size and easily carried by the golfer, sets forth a list of putting absolutes and a list of sound putting principles. The manual further sets forth a series of putting drills appropriately illustrated to instruct the golfer upon the use of one or more practice putting balls in conjunction with regulation golf balls utilizing the sound putting principles to seek perfection in achieving the three putting absolutes.

DESCRIPTION OF INVENTION

As previously stated, it has been observed that golfers are hit orientated. They tense up and pull the putter off line in their attempt to strike the golf ball rather than stroking it. Through experimentation with different size golf balls, the inventor has come to the conclusion that the size of the ball has very much to do with the smoothness of the attempt to stroke. The more the ball grew in size, the smoother the stroke became. It was further noted that the optimum size for a golf ball to experience this phenomenon was in the area of 2½ inches in diameter as compared with the diameter of a regulation golf ball of 1.68 inches. However, the effect could be experienced with golf balls with a diameter as little as 2 inches and up to a diameter of 3 inches.

The inventor further from his studies concluded that the oversized golf balls must have the same weight and feel as a regulation golf ball in order to train golfers to swing with a smooth pendulum putting motion. It was found at this point of study that putting balls of different weight other than that of a regulation golf ball became detrimental to developing a good stroke, the reason being the precise timing needed to successfully sink a putt is thrown off if the ball weighs any different than a regulation golf ball, destroying the proper sense of timing. A regulation golf ball weighs 1.62 ounces.

The inventor further concluded that the surface resiliency characteristics of a practice ball in an oversized configuration must be essentially the same as that of a regulation golf ball. Regulation golf balls are made of various compositions, one being a Dupont product known as Surlyn and another, a natural product, known as Balata.

The inventor's experimentation with oversized golf balls in studies of practice putting with golfers has brought him to the conclusion that, after a short period of practice with the oversized golf balls, a regulation golf ball appears much smaller than normal to the practicing putter and likewise, the 4¼ inch diameter golf ball hole appears much larger in comparison to the regulation golf ball. This readjustment of perspective of the practicing putter following use of the oversized golf ball instantly brings confidence to the golfer in his putting stroke.

Figure 1:
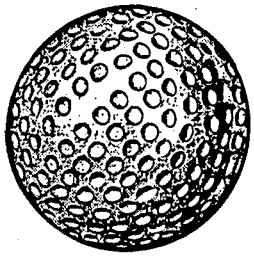
FIG. 1 illustrates a prior art regulation golf ball.
Figure 2:
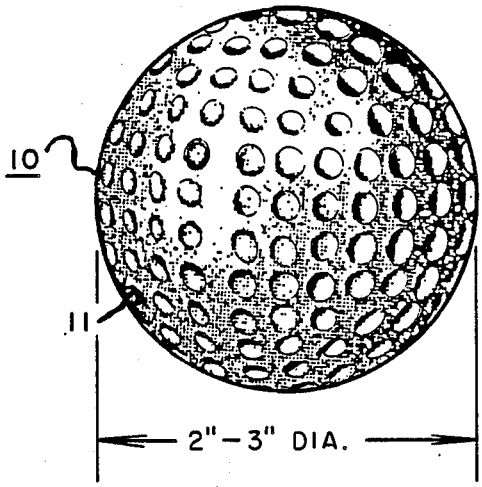
PRIOR ART Fig. 2
FIG. 2 illustrates the putting practice ball of the present invention in proportionate size to a regulation golf ball.
Figure 3:
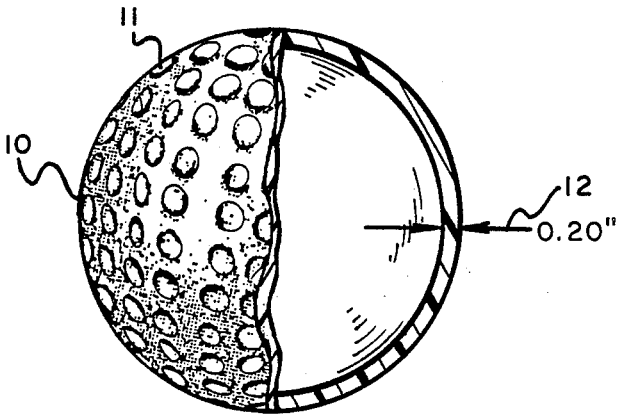
FIG. 3 is a cutaway view of the practice putting ball of FIG. 2.
Figure 4:
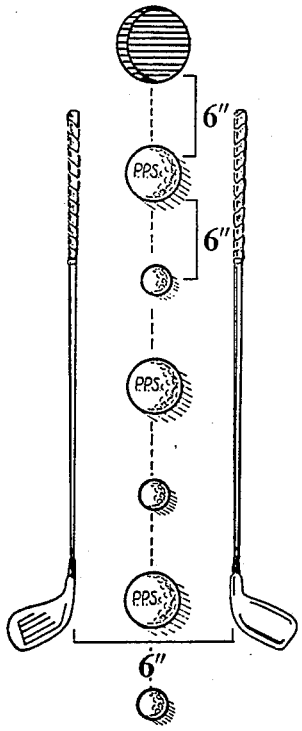
FIGS. 4–7 illustrate the manner in which the practice putting balls of the present invention may be utilized in four practice drills in accordance with the practice putting system of the present invention.
Figure 5:
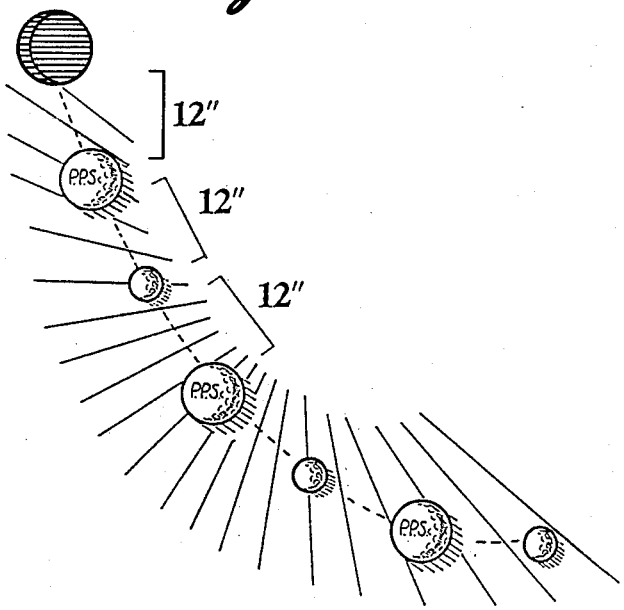
Figure 6:
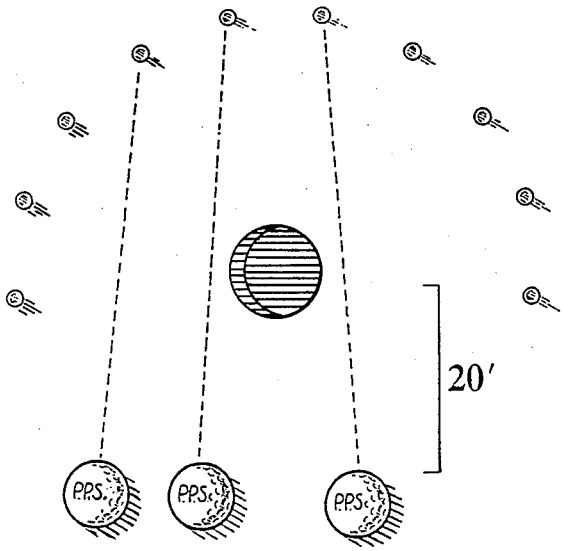
Figure 7:
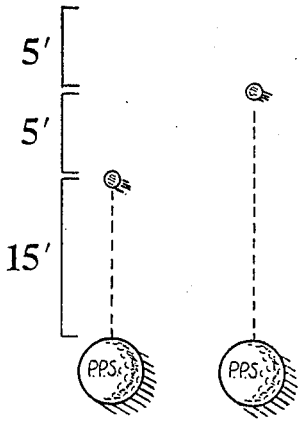

As a result of the foregoing study and conclusions, the inventor, as a part of his practice putting system, designed a practice putting ball 10 as shown in FIGS. 2 and 3 of the drawings. FIG. 1 shows a prior art regulation golf ball whereas FIGS. 2 and 3 show the proportionate increase in size of the putting practice ball 10 relative to a regulation golf ball.

In a preferred embodiment of the putting practice ball of FIGS. 2 and 3, the ball is of a diameter of 2.50 inches although the ball can be successfully used to teach putting if it is within the range of 2.0 inches to 3.0 inches as compared to the golf ball hole diameter of 4.25 inches. A golf ball of 2.50 inches is 52% larger than a regulation golf ball whose diameter is 1.68 inches.

The putting practice ball 10 of the present invention, as shown in FIGS. 2 and 3, is of a weight of 1.62 ounces. This is the identical weight of a regulation golf ball.

The outer surface of the putting practice ball 10 of the present invention includes an array of dimples 11 therein substantially identical to the array of dimples on a regulation golf ball. However, the size of the dimples 11 are proportionately larger than those of a regulation golf ball in accordance with the proportional differences between the diameter of the practice putting ball 10 and the regulation golf ball shown in FIG. 1 of the drawings. In the particular case of the putting practice golf ball 10 shown in FIGS. 2 and 3 wherein the diameter of the golf ball is 2.50 inches, the dimples are 0.214 inches in diameter, 0.022 inches deep and disposed from their center to center on radii 11.25° apart. The spacing between the dimples is approximately 0.031 inches.

The putting practice ball 10 of the present invention, in a preferred embodiment, is formed of two injection molded half shells cemented together along a parting line (not shown). The half shells have a wall thickness 12, as shown in FIG. 3 and for the 2.50 inch diameter ball, of approximately 0.20 inches.

In a preferred embodiment, the putting practice ball 10 of the present invention is injected molded from a Dupont product known as Hytrel 5555 HS which is a polyester elastomer. The combination of this material in a 2.50 inch diameter and a wall thickness of 0.20 inches will provide a weight of 1.62 ounces, the same as a regulation golf ball. The Hytrel material in this configuration provides a surface resiliency essentially that of a regulation golf ball.

As a further part of the practice putting system of the present invention, there is provided a small pocket-size pamphlet (not shown) wherein there are stated the three putting absolutes and ten sound putting principles as set forth in the foregoing background of invention. In addition, the manual sets forth four putting drills utilizing a plurality of the putting practice balls of the present invention in conjunction with regulation golf balls. The four putting drills are designed to prepare golfers for every situation that can appear on a putting surface and equip the golfer with the knowledge and feel to successfully putt a golf ball on a putting surface.

The four drills cover making a one foot putt to making a six foot putt and to routinely two putt from 20 feet. The drills allow the golfer to develop the feel to putt the golf ball a desired distance, to swing the putter down a direct path to the target and to keep the putter face square to the target. The drills also train golfers to swing with a short compact swing that at will not break under pressure.

FIGS. 4–7 of the present invention illustrate the four putting drills as indicated therein. A summary of the four drills is as set hereinafter:

DRILL NO. 1

EQUIPMENT

Two long irons
Three practice putting balls
Three regulation size golf balls
A relatively flat putting surface.

DIRECTIONS

First, place the two long irons parallel and on opposite sides of the putting hole with the grip end of the clubs closest to the hole forming a path approximately 6 inches wide. Second, place a practice putting ball between the clubs and approximately 6 inches from the hole. Then, place a regulation size golf ball 6 inches directly behind the practice putting ball. Alternate the remaining practice putting balls and regulation golf balls the same way. Third, begin to putt.

PURPOSE

The purpose of Drill 1 is to build confidence by putting with the practice putting balls and seeing the regulation size ball appear smaller and the hole larger with each consecutive putt. Also, by placing the balls 6 inches directly behind each other, the golfer is forced to use the correct putting stroke, which is a short back swing and a long follow-through rather than the opposite, creating the possibility for a greater margin of error. The drill also reinforces the first two putting absolutes where were (1) the putter blade must be square or straight to the target and (2) the putter blade must swing directly toward the target. These can both be easily cross referenced by the two parallel clubs placed on either side of the hole. The putter blade must be square in relationship to the two parallel clubs and the blade must swing down the path created by the clubs.

NOTE: The hole will tend to fill up quickly due to the large size of the practice putting balls. However, continue putting to the target and do not interrupt the flow of the drill. A tee may be substituted for the target rather than the hole for this drill and Drill 2 if this presents a problem.

DRILL NO. 2

EQUIPMENT

Three practice putting balls
Three regulation size golf balls
A putting surface with a break in it.

DIRECTIONS

First, place a practice putting ball 12 inches from the hole. Second, place a regulation size golf ball behind the practice putting ball also 12 inches apart on the angle of the break. Third, alternate practice putting balls and regulation size golf balls 12 inches apart similar to Drill 1.

PURPOSE

The purpose of Drill 2 is to build confidence with a break in the putting surface. When putting with this drill, it can easily be seen how a putt breaks on the green. By experimenting with every type of break that may occur, reading a green will become quick and easy and those once troublesome putts will roll right in.

DRILL NO. 3

EQUIPMENT

Three practice putting balls
Three regulation size golf balls
A handful of tees.

DIRECTIONS

First, make a semi-circle with the golf tees approximately a putter's length around the golf hole. Second, begin putting the practice putting balls approximately 20 feet away from the hole aiming for the area within the golf tees. After putting with the practice putting balls for a short time, begin to alternate putts with regulation size golf balls.

PURPOSE

The purpose of Drill 3 is to roll long distance putts within 3 feet of the hole creating an easy "tap-in" resulting in lower golf scores. After putting with the large practice putting ball for a short period of time, it becomes much easier to keep the regulation size golf balls within a 3 feet area and "tap ins" become routine.

DRILL NO. 4

EQUIPMENT

Three practice putting balls
Three regulation size golf balls
Three golf tees.

DIRECTIONS

Place the practice putting balls together anywhere on the green as a starting point. Place the first tee approximately 15 feet from the practice putting balls. Place the second tee an additional 5 feet farther from the first tee and the third tee 5 feet farther from the second tee. Putt the first practice putting ball to the first tee and the second practice putting ball to the second tee and the third practice putting ball to the third tee. After a short period of time, begin to alternate practice putting balls with regulation size golf balls.

PURPOSE

The purpose of Drill 4 is to reinforce the third putting absolute which is developing the feel to roll the golf ball a desired distance from the putter blade to the hole. While practicing with practice putting balls Drill 4, take note of the length of the backswing and follow-through. Become familiar with the distance the ball rolls in comparison to the length of the swing. Also notice while putting with the practice putting balls how smoothly and evenly the stroke feels, rather than uneven and choppy.

From the foregoing description of the practice putting ball of the present invention and the instruction manual associated therewith, it will be appreciated that the system will train golfers to swing with a smooth pendulum motion and will instill confidence in the golfer's ability to sink putts. Golfers will be prepared for every situation they face on the putting green.

The practice putting ball and manual forming the practice putting system of the present invention has been described in respect to a particular embodiment thereof as described in the specification and shown in the drawings. Other variations and modifications thereof will become apparent to those skilled in the art in view of the foregoing and therefore, no limitation as to the scope of the invention as thereby intended but the scope of the invention is to be interpreted in view of the appended claims.

What is claimed is:

1. A golf putting practice ball comprising:
a spherical ball having an array of dimples thereon, a weight not greater than 1.62 ounces, and a diameter in the range of 2" to 3".

2. The practice ball of claim 1 wherein the practice ball has the surface resiliency of a regulation United States Golf Association (USGA) golf ball.

3. The practice ball of claim 2 further including putting instruction means prescribing certain putting drills based upon certain putting principles utilizing one or more practice balls to achieve proficiency of certain putting absolutes to thus form a golf putting practice system.

4. The practice ball of claim 1 further including putting instruction means prescribing certain putting drills based upon certain putting principles utilizing one or more practice balls to achieve proficiency of certain putting absolutes to thus form a golf putting practice system.

* * * * *